US012179888B1

(12) United States Patent
Xie

(10) Patent No.: US 12,179,888 B1
(45) Date of Patent: Dec. 31, 2024

(54) RECREATIONAL WATER FLOAT AND METHOD FOR MANUFACTURING SAME

(71) Applicant: Shenzhen Jiaxin Technology Co., Ltd, Shenzhen (CN)

(72) Inventor: Penghui Xie, Shenzhen (CN)

( * ) Notice: Subject to any disclaimer, the term of this patent is extended or adjusted under 35 U.S.C. 154(b) by 0 days.

(21) Appl. No.: 18/434,339

(22) Filed: Feb. 6, 2024

(30) Foreign Application Priority Data

Jan. 22, 2024 (CN) ..... 202420149235.6

(51) Int. Cl.
*B63B 34/52* (2020.01)
*B63B 7/08* (2020.01)

(52) U.S. Cl.
CPC ..... *B63B 34/52* (2020.02); *B63B 7/08* (2013.01)

(58) Field of Classification Search
CPC ..... B63B 34/52; B63B 7/08
See application file for complete search history.

(56) References Cited

U.S. PATENT DOCUMENTS 3,638,253 A * 2/1972 Stumpf ..... A47G 9/1027 5/644
5,406,653 A * 4/1995 Todor ..... A47C 15/006 441/130
5,411,425 A * 5/1995 Rinker ..... B63B 43/14 441/130
5,791,958 A * 8/1998 Yeung ..... A47C 15/006 441/130

* cited by examiner

*Primary Examiner* — Stephen P Avila

(57) ABSTRACT

A water float includes a first part sheet, a middle part sheet, and a second part sheet. The three sheets are three parts of a single original sheet. The first part sheet and the second part sheet are respectively folded and sealingly connected to form a first and second inflatable floating chamber. The first inflatable floating chamber and the second inflatable floating chamber are configured to provide buoyancy in water, while the middle part sheet is configured to support user. When in use, fold and flip the first and second part sheet along centerline, stacking the first and second part sheet on top of each other, and then seal each edge of the first and second part sheet to form the sealed first and second inflatable floating chamber. A method for manufacturing a water float is also provided.

16 Claims, 6 Drawing Sheets

RECREATIONAL WATER FLOAT AND METHOD FOR MANUFACTURING SAME

CROSS-REFERENCE TO RELATED APPLICATIONS

The application claims priority of Chinese patent application CN2024201492356, filed on Jan. 22, 2024, which is incorporated herein by reference in its entireties.

TECHNICAL FIELD

The present disclosure relates to the technical field of water entertainment and leisure equipment technology, particularly to a water float and a method for manufacturing a water float.

BACKGROUND

In hot summer, cool water surface is a popular leisure place where people often engage in activities such as swimming and drifting. Among these, people particularly enjoy the feeling of floating on the water surface, which relaxes body and cools down in heat, and a recreational water float can assist users in floating on water, as well as serve as a life-saving device, therefore, water floats are widely favored by people.

However, existing water hammock-type water floats are mostly of following two types, using two different production processes. A first type of product's inflatable chamber is formed by connecting two circular sheets and a roll-shaped sheet, connected to a middle support net, the production process is complex, requiring many connecting parts, resulting in a low yield rate of product, poor air-tightness, and poor load-bearing capacity, easily breaking at connecting points. A second type of product's inflatable chamber is formed by stacking and pressing two sheets on top of each other, then pressing them with a middle support net. The support net of the second type of product requires edge stitching, and the product is provided with many connecting points with poor sealing, low strength, and weak load-bearing capacity, easily breaking at connecting points, leading to poor product quality.

To address these issues, the present disclosure provides a water float that can effectively solve problems mentioned above with a simple structure, stable connections, good sealing effect, and simple production process.

SUMMARY

In order to overcome the shortcomings of the prior art, the present disclosure provides a water float which has a simple structure, stable connections, good sealing effect, and simple production process.

The technical solution adopted by the present disclosure to solve the technical problem is as follows.

The present disclosure provides a water float, including a first part sheet, a middle part sheet, and a second part sheet, wherein the first part sheet, the middle part sheet, and the second part sheet are three parts of a single original sheet, a portion of the first part sheet is folded and scalingly connected along edges to form a first inflatable floating chamber, and a portion of the second part sheet is folded and scalingly connected along edges to form a second inflatable floating chamber, the first inflatable floating chamber and the second inflatable floating chamber are configured to provide buoyancy in water, and the middle part sheet is configured to support user.

As the improvement of the present disclosure, the first part sheet includes a first folding part and a first connecting part, the first connecting part is connected to an end of the middle part sheet, the first folding part is connected to the first connecting part, and an edge of the first folding part is scalingly connected to an edge of the first connecting part to form the first inflatable floating chamber.

As the improvement of the present disclosure, the first folding part is provided with a first free end and two first side edges, the first connecting part is provided with two second side edges, the first free end is scalingly connected to an end of the first connecting part near the middle part sheet, and the first side edge is sealingly connected to the second side edge.

As the improvement of the present disclosure, the second part sheet includes a second folding part and a second connecting part, the second connecting part is connected to the end of the middle part sheet, the second folding part is connected to the second connecting part, and an edge of the second folding part is sealingly connected to an edge of the second connecting part to form the second inflatable floating chamber.

As the improvement of the present disclosure, the second folding part is provided with a second free end and two third side edges, the second connecting part is provided with two fourth side edges, the second free end is scalingly connected to an end of the second connecting part near the middle part sheet, and the third side edge is sealingly connected to the fourth side edge.

As the improvement of the present disclosure, the water float further includes a first inflation valve, the first folding part or the first connecting part is provided with a first air hole communicating with the first inflatable floating chamber, and the first inflation valve is scalingly connected to the first air hole and allows gas to enter or be expelled.

As the improvement of the present disclosure, the water float further includes a second inflation valve, the second folding part or the second connecting part is provided with a second air hole communicating with the second inflatable floating chamber, and the second inflation valve is sealingly connected to the second air hole and allows gas to enter or be expelled.

As the improvement of the present disclosure, the middle part sheet is provided with a plurality of through holes in middle.

As the improvement of the present disclosure, the through holes are arranged in a rectangular array.

The present disclosure also provides a method for manufacturing a water float, including providing a first part sheet, a middle part sheet, and a second part sheet, wherein the first part sheet, the middle part sheet, and the second part sheet are three parts of a single original sheet, folding a portion of the first part sheet and scalingly connect along edges to form a first inflatable floating chamber, and folding a portion of the second part sheet and scalingly connect along edges to form a second inflatable floating chamber, the first inflatable floating chamber and the second inflatable floating chamber are configured to provide buoyancy in water, and the middle part sheet is configured to support user.

As the improvement of the present disclosure, the first part sheet includes the first folding part and the first connecting part, the first connecting part is connected to the end of the middle part sheet, the first folding part is connected to the first connecting part, and scalingly connect the edge of the first folding part to the edge of the first connecting part to form the first inflatable floating chamber.

As the improvement of the present disclosure, the first folding part is provided with a first free end and two first side edges, the first connecting part is provided with two second side edges, sealingly connect the first free end to an end of the first connecting part near the middle part sheet, and scalingly connect the first side edge to the second side edge.

As the improvement of the present disclosure, the second part sheet includes a second folding part and a second connecting part, the second connecting part is connected to an end of the middle part sheet, the second folding part is connected to the second connecting part, and sealingly connect an edge of the second folding part to an edge of the second connecting part to form the second inflatable floating chamber.

As the improvement of the present disclosure, the second folding part is provided with a second free end and two third side edges, the second connecting part is provided with two fourth side edges, scalingly connect the second free end to an end of the second connecting part near the middle part sheet, and scalingly connect the third side edges to the fourth side edges.

As the improvement of the present disclosure, the method for manufacturing a water float further includes a first inflation valve, the first folding part or the first connecting part is provided with a first air hole communicating with the first inflatable floating chamber, and sealingly connected the first inflation valve to the first air hole and allows gas to enter or be expelled.

As the improvement of the present disclosure, the method for manufacturing a water float further includes a second inflation valve, the second folding part or the second connecting part is provided with a second air hole communicating with the second inflatable floating chamber, and scalingly connect the second inflation valve to the second air hole and allows gas to enter or be expelled.

As the improvement of the present disclosure, a plurality of through holes are provided in a middle part of the middle part sheet.

As the improvement of the present disclosure, the through holes are arranged in a rectangular array.

The present disclosure has the following beneficial effects. With the above structure, when in use, folding and flipping the first part sheet along a centerline, stacking two parts of the first part sheet on top of each other, and sealing edges of the first part sheet to form the scaled first inflatable floating chamber. Similarly, folding and flipping the second part sheet along the centerline, stacking two parts of the second part sheet on top of each other, and scaling edges of the second part sheet to form the sealed second inflatable floating chamber. Inflating air into the first inflatable floating chamber and the second inflatable floating chamber to provide buoyancy for the product, while the middle part sheet supports the user's body. Using an integral original sheet and folding and sealing method reduces processing steps and improves the production efficiency of the product. With fewer parts needing to be sealed and connected, enhancing product's seal integrity and strength, reducing risk of tearing and air leakage at scaling and connecting positions, ensuring product stability, and lowering production costs. The sealing method typically involves high-frequency voltage or heat fusion welding processes. Such scaling methods can fuse sealed parts together, ensuring an airtight chamber and maintaining a stable structure of the product.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
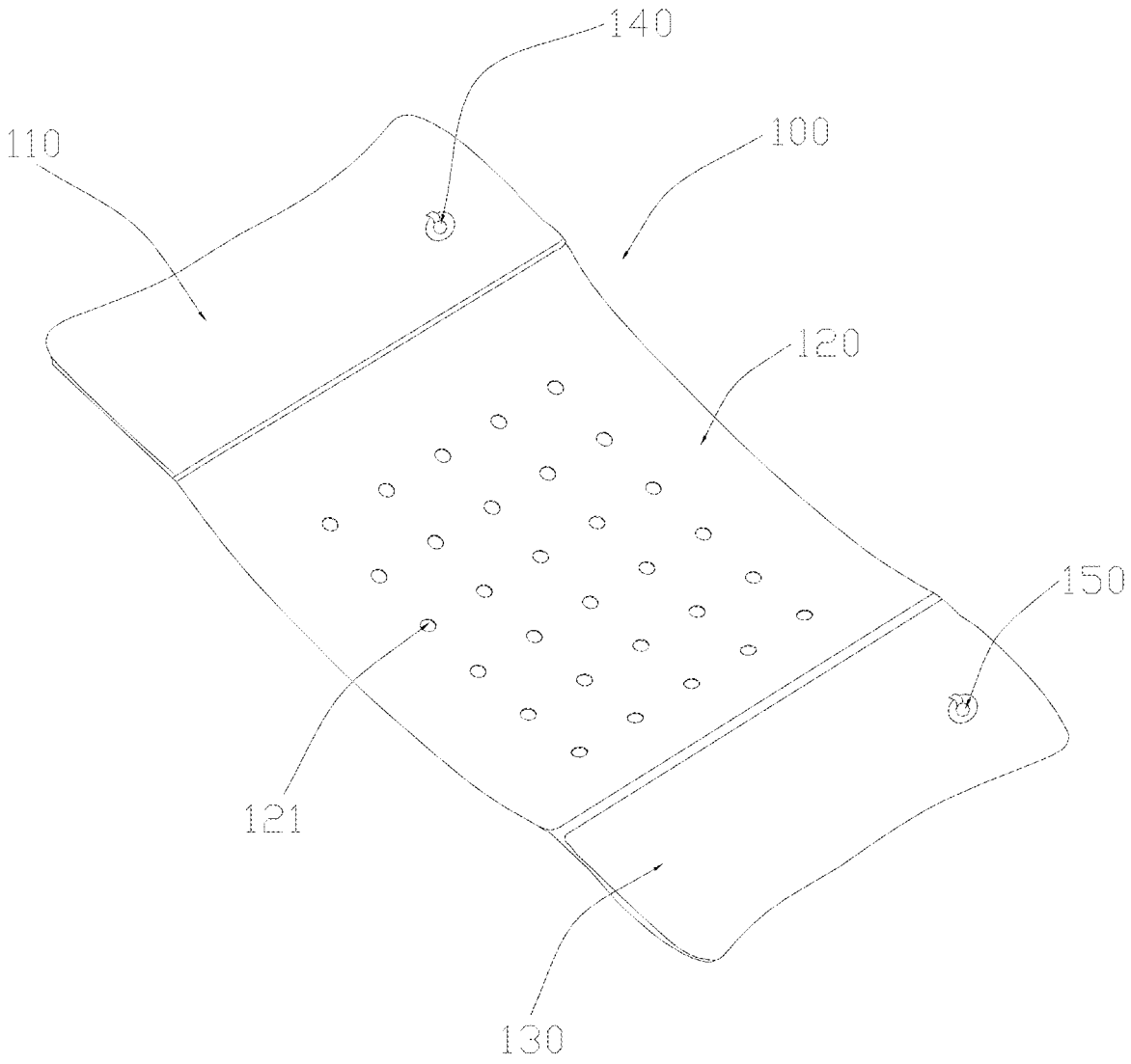
FIG. 1 is a schematic view of an overall structure of a water float of the present disclosure from one angle.
Figure 2:
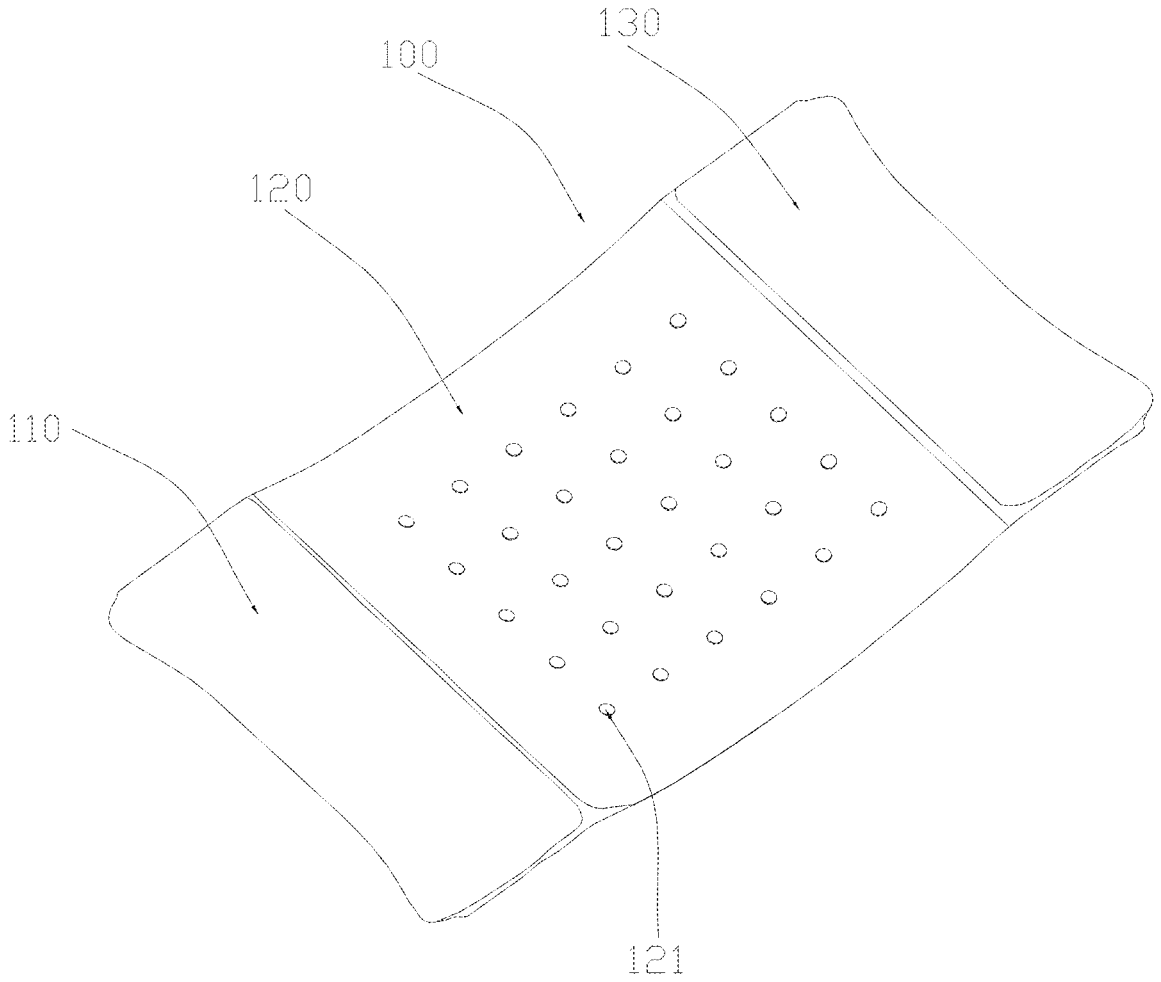
FIG. 2 is a schematic view of the overall structure of the water float of the present disclosure from another angle.
Figure 3:
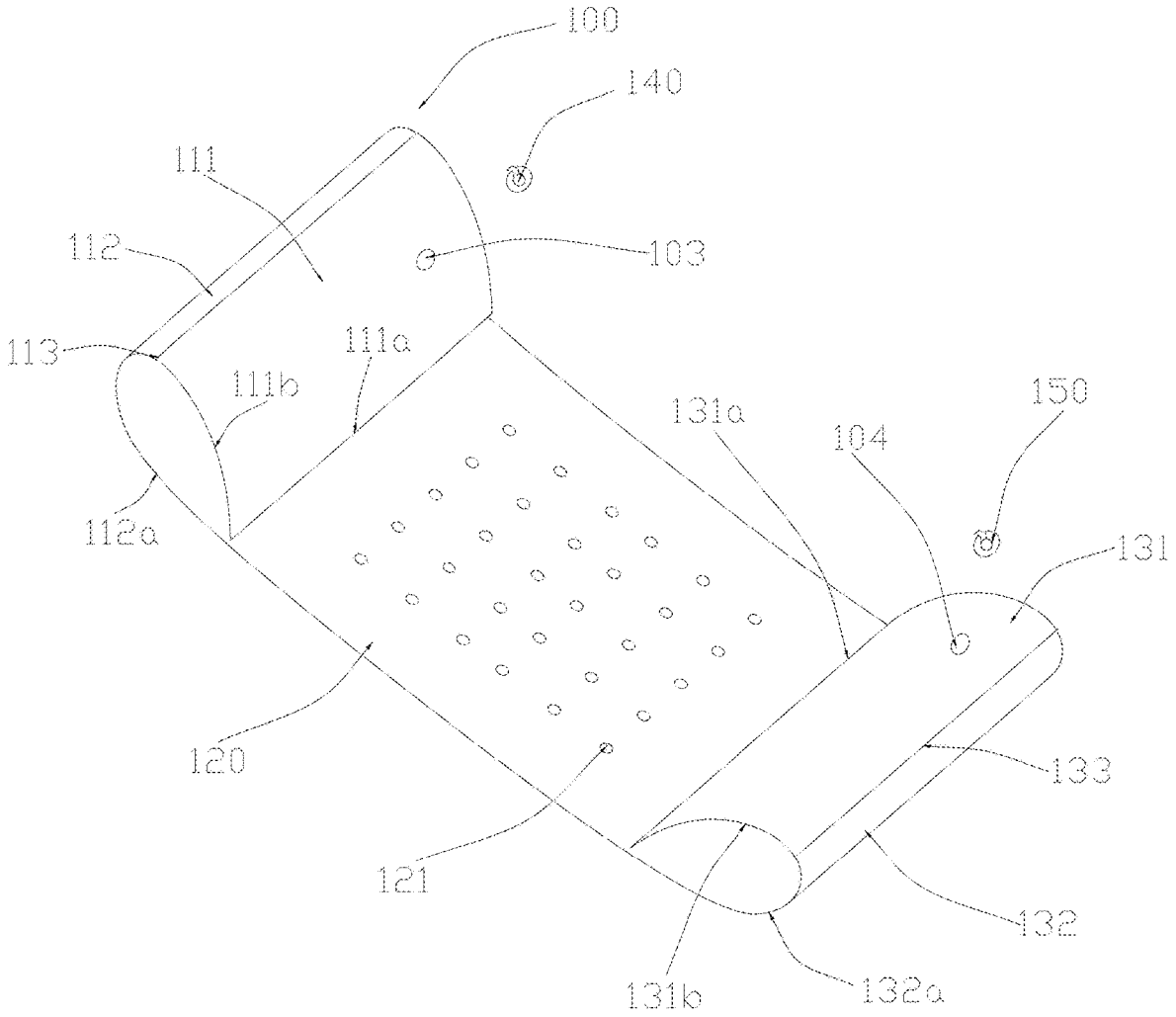
FIG. 3 is a schematic view of a production process of the water float of the present disclosure from one angle.
Figure 4:
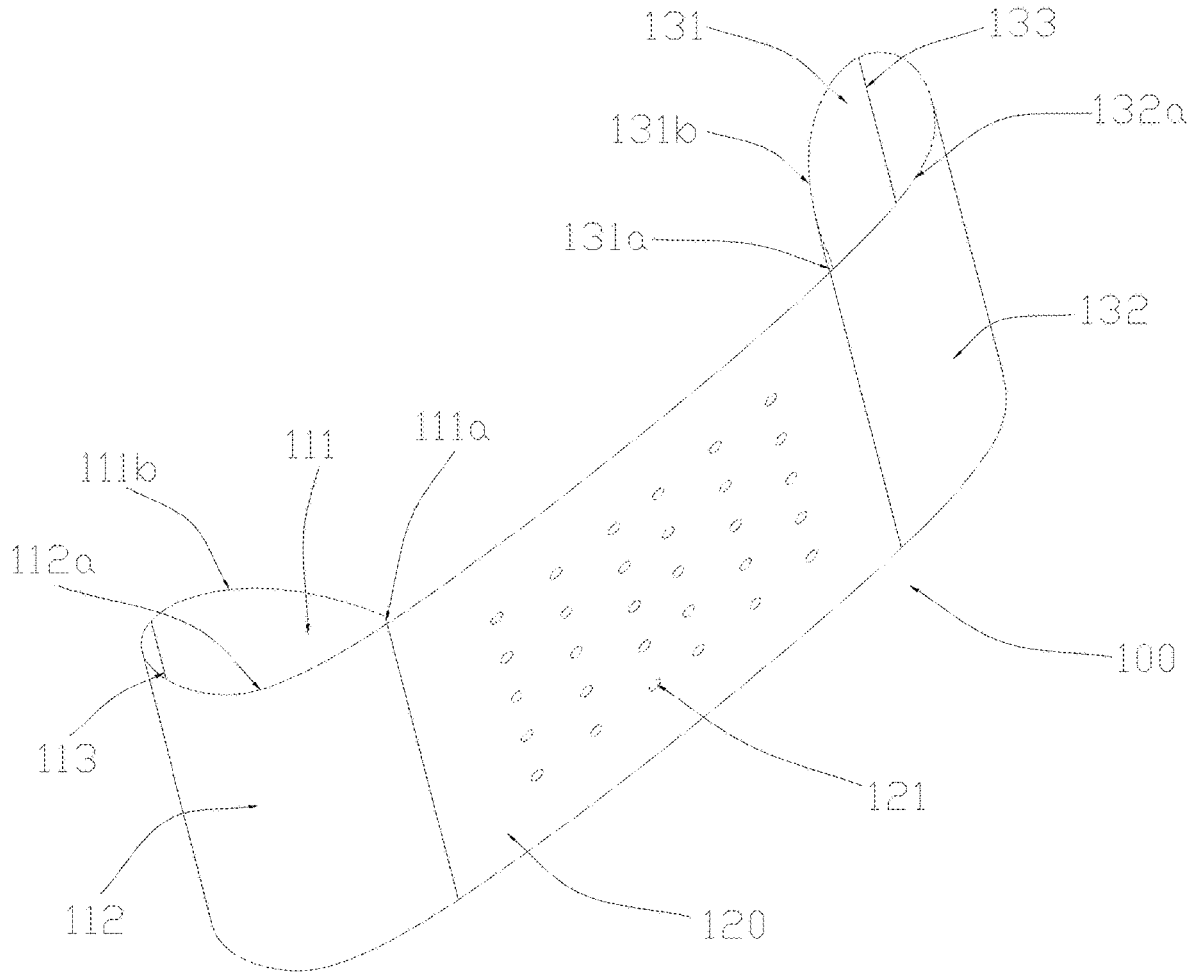
FIG. 4 is a schematic view of the production process of the water float of the present disclosure from another angle.
Figure 5:
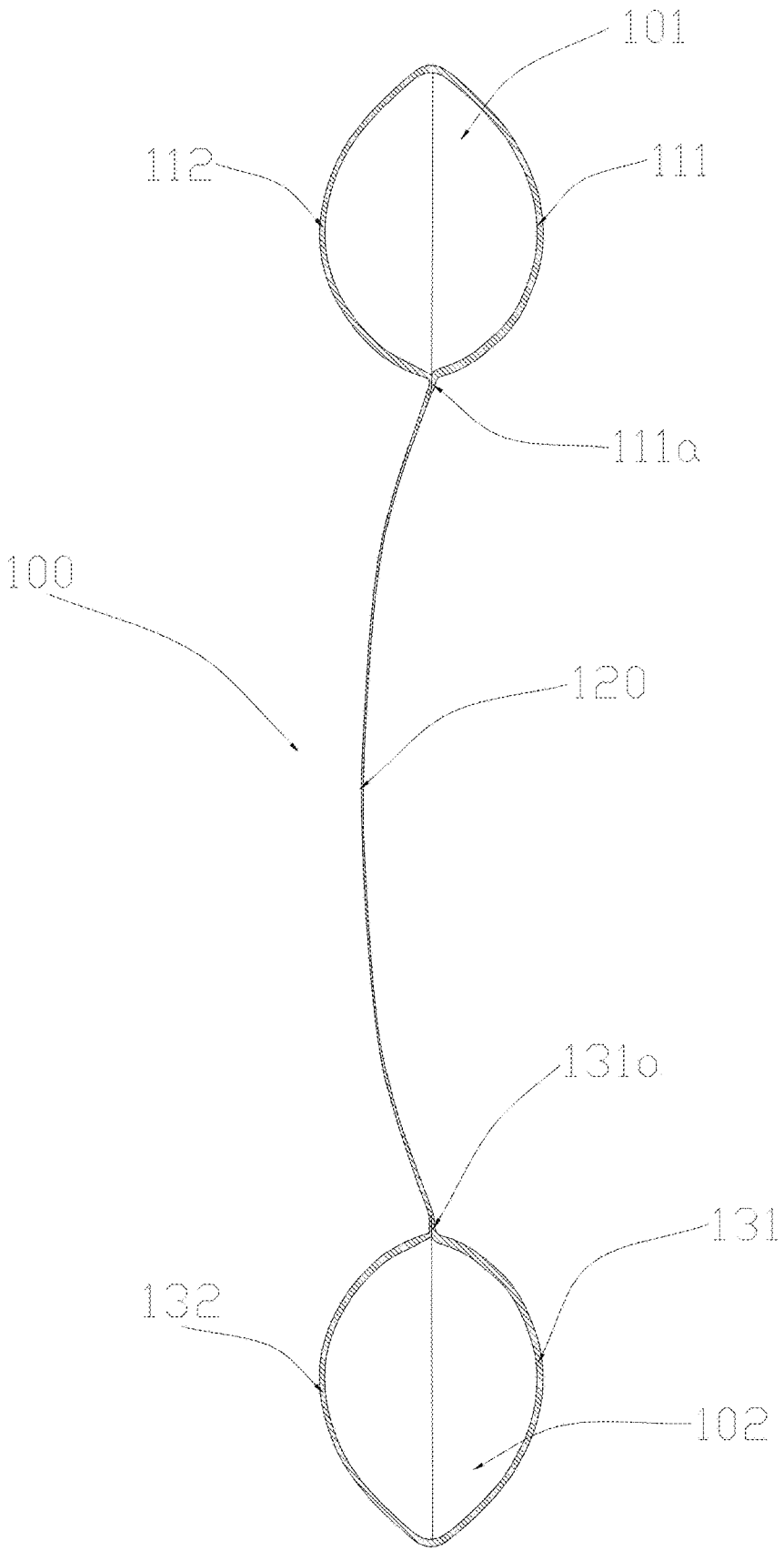
FIG. 5 is a cross-sectional structural schematic view of the water float of the present disclosure.
Figure 6:
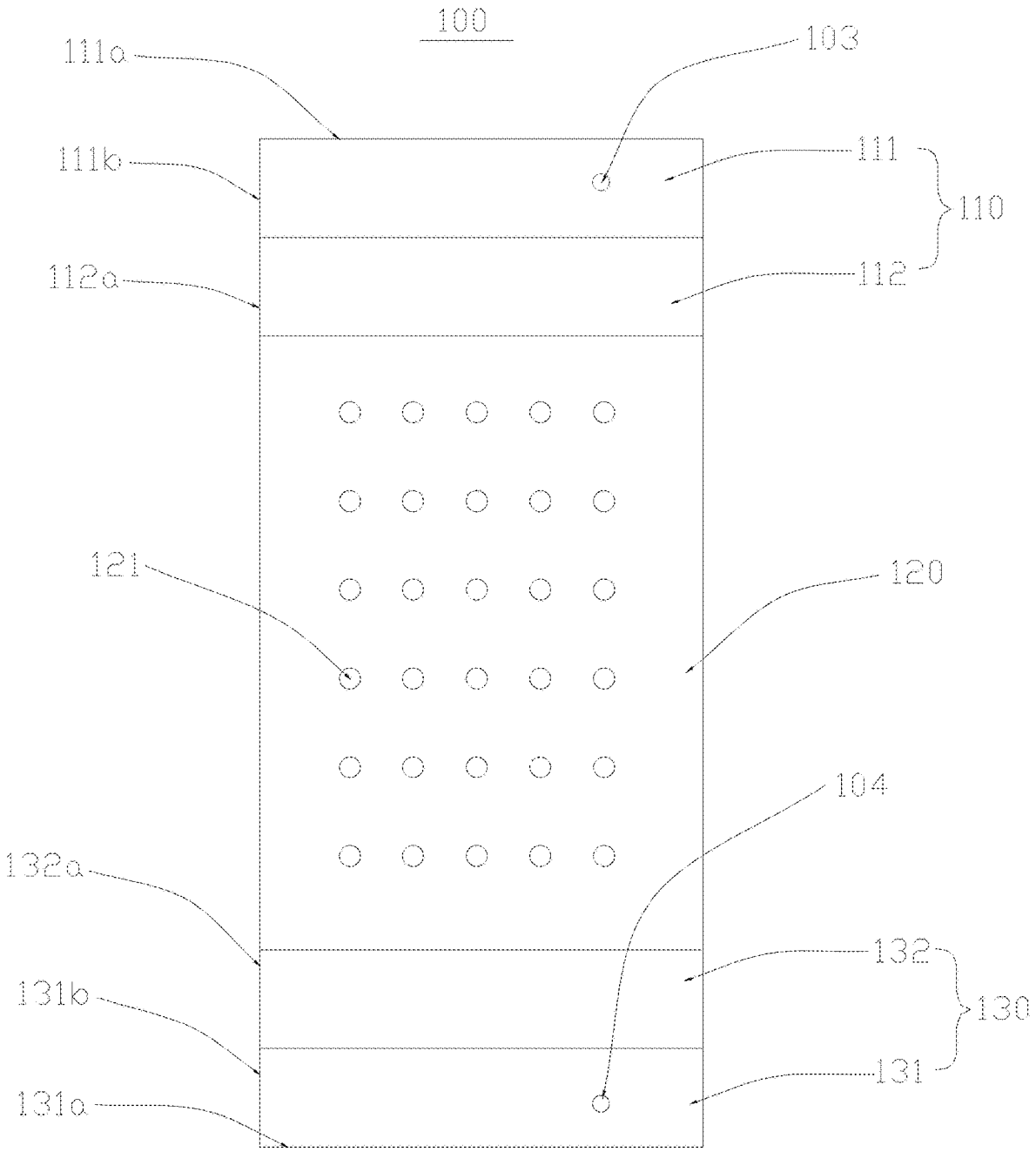
FIG. 6 is a schematic view of an original sheet in an unfolded state of the present disclosure.

Referring to FIG. 1 to FIG. 6, a water float, including a first part sheet 110, a middle part sheet 120, and a second part sheet 130. The first part sheet 110, the middle part sheet 120, and the second part sheet 130 are three parts of a single original sheet 100. A portion of the first part sheet 110 is folded and sealingly connected along edges to form a first inflatable floating chamber 101, and a portion of the second part sheet 130 is folded and sealingly connected along edges to form a second inflatable floating chamber 102. The first inflatable floating chamber 101 and the second inflatable floating chamber 102 are configured to provide buoyancy in water, and the middle part sheet 120 is configured to support the user.

With the above structure, when in use, folding and flipping the first part sheet 110 along a centerline, stacking two parts of the first part sheet 110 on top of each other, and sealing edges of the first part sheet to form the sealed first inflatable floating chamber 101. Similarly, folding and flipping the second part sheet 130 along the centerline, stacking two parts of the second part sheet 130 on top of each other, and sealing edges of the second part sheet to form the sealed second inflatable floating chamber 102. Inflating air into the first inflatable floating chamber 101 and the second inflatable floating chamber 102 to provide buoyancy for the product, while the middle part sheet 120 supports the user's body. Using an integral original sheet and folding and sealing method reduces processing steps and improves the production efficiency of the product. With fewer parts needing to be sealed and connected, enhancing product's seal integrity and strength, reducing risk of tearing and air leakage at scaling and connecting positions, ensuring product stability, and lowering production costs. The sealing method typically involves high-frequency voltage or heat fusion welding processes. Such sealing methods can fuse sealed parts together, ensuring an airtight chamber and maintaining a stable structure of the product. In this embodiment, the first part sheet 110 includes a first folding part 111 and a first connecting part 112. The first connecting part 112 is connected to an end of the middle part sheet 120, and the first folding part 111 is connected to the first connecting part 112. An edge of the first folding part 111 is sealingly connected to an edge of the first connecting part 112 to form the first inflatable floating chamber 101. With the above structure, a first mark line 113 is provided at a joint of the first folding part 111 and the first connecting part 112. By flipping along the first mark line 113, folding of the first part sheet 110 can be quickly achieved, facilitating the user to align the edge of the first folding part 111 with the edge of the first connecting part 112, and then quickly seal and connect the edge of the first folding part 111 to the edge of the first connecting part 112. This effectively improves the production efficiency and yield rate of the product; Wherein, the shape of the first folding part 111 and the shape of the first connecting part 112 are substantially same and rectangular, which effectively improves the utilization rate of the original sheet 100, prevents waste, and saves costs.

In this embodiment, the first folding part 111 is provided with a first free end 111*a* and two first side edges 111*b*, and the first connecting part 112 is provided with two second side edges 112*a*, the first free end 111*a* is scalingly connected to an end of the first connecting part 112 near the middle part sheet 120, and the first side edge 111*b* is sealingly connected to the second side edge 112*a*. With the above structure, when in use, the first free end 111*a* is scalingly connected to the end of the first connecting part 112 near the middle part sheet 120, and the first side edge 111*b* is sealingly connected to the second side edge 112*a*, such that the sealed first inflatable floating chamber 101 is formed, which can stably provide buoyancy for the product, and the connection is stable, making the product more robust and durable.

In this embodiment, the second part sheet 130 includes a second folding part 131 and a second connecting part 132. The second connecting part 132 is connected to the end of the middle part sheet 120, and the second folding part 131 is connected to the second connecting part 132. An edge of the second folding part 131 is sealingly connected to an edge of the second connecting part 132 to form the second inflatable floating chamber 102. With the above structure, a second mark line 133 is provided at the joint of the second folding part 131 and the second connecting part 132. By flipping along the second mark line 133, the folding of the second part sheet 130 can be quickly achieved, facilitating the user to align the edge of the second folding part 131 with the edge of the second connecting part 132, and then quickly scalingly connect the edge of the second folding part 131 and the edge of the second connecting part 132. This effectively improves the production efficiency and yield rate of the product. Wherein, the shape of the second folding part 131 and the shape of the second connecting part 132 are substantially the same and rectangular, which effectively improves the utilization rate of the original sheet 100, prevents waste, and saves costs.

In this embodiment, the second folding part 131 is provided with a second free end 131*a* and two third side edges 131*b*, and the second connecting part 132 is provided with two fourth side edges 132*a*. The second free end 131*a* is scalingly connected to an end of the second connecting part 132 near the middle part sheet 120, and the third side edge 131*b* is scalingly connected to the fourth side edge 132*a*. With the above structure, when in use, the second free end 131*a* is sealingly connected to the end of the second connecting part 132 near the middle part sheet 120, and the third side edge 131*b* is sealing connected to the fourth side edges 132*a*, such that the scaled second inflatable floating chamber 102 is formed, which can stably provide buoyancy for the product, and the connection is stable, making the product more robust and durable.

In this embodiment, a first inflation valve 140 is also provided. The first folding part 111 or the first connecting part 112 is provided with a first air hole 103 that communicates with the first inflatable floating chamber 101. The first inflation valve 140 is scalingly connected to the first air hole 103 and allows gas to enter or be expelled. With the above structure, the first inflation valve 140 is scalingly connected to the first air hole 103, which securely attaches the first inflation valve 140 to the first air hole 103 and ensures the air-tightness of the product. when in use, inserting an inflation device into the first inflation valve 140 to inflate. A check valve inside the inflation valve effectively allows gas to enter the first inflatable floating chamber 101 in a one-way manner, ensuring the product's air-tightness, filling the first inflatable floating chamber 101 with sufficient gas to provide buoyancy to support the user's body. Additionally, when deflation is needed for the product, the check valve can be pressed to release the gas from the first inflatable floating chamber 101, reducing the product's volume for convenient portability.

In this embodiment, a second inflation valve 150 is also provided. The second folding part 131 or the second connecting part 132 is provided with a second air hole 104 that communicates with the second inflatable floating chamber 102. The second inflation valve 150 is scalingly connected to the second air hole 104 and allows gas to enter or be expelled. With the above structure, the second inflation valve 150 is sealingly connected to the second air hole 104, which attaches the second inflation valve 150 to the second air hole 104 and ensures the air-tightness of the product. when in use, inserting an inflation device into the second inflation valve 150 to inflate. The check valve inside the inflation valve effectively allows gas to enter the second inflatable floating chamber 102 in a one-way manner, ensuring the product's air-tightness, filling the second inflatable floating chamber 102 with sufficient gas to provide buoyancy to support the user's body. Additionally, when deflation is needed for the product, the check valve can be pressed to release the gas from the second inflatable floating chamber 102, reducing the product's volume for convenient portability.

In this embodiment, the middle part sheet 120 is provided with a plurality of through holes 121 in middle. With the above structure, the through holes 121 allow air and water to pass through, enhancing user comfort, and preventing the middle part sheet 120 from extensively adhering to the user's skin and also enhancing the aesthetic appeal of the product.

In this embodiment, the through holes 121 are arranged in a rectangular array. With the above structure, the through holes 121 arranged in a rectangular array allow a consistent distance between adjacent through holes 121, ensuring the product's strength and durability. Additionally, the regularly arranged through holes 121 enhance the product's aesthetic appeal. Preferably, the through holes 121 can also be arranged in other shapes, such as circular arrays, etc.

Referring to FIGS. 1 to 6, a method for manufacturing a water float includes providing the first part sheet 110, the middle part sheet 120, and the second part sheet 130. The first part sheet 110, the middle part sheet 120, and the second part sheet 130 are three parts of the single original sheet 100. Folding a portion of the first part sheet 110 and scalingly connect along edges to form the first inflatable floating chamber 101, and folding a portion of the second part sheet 130 and scalingly connect along edges to form the second inflatable floating chamber 102. The first inflatable floating chamber 101 and the second inflatable floating chamber 102 are configured to provide buoyancy in water, and the middle part sheet 120 is configured to support the user.

With the above structure, when in use, folding and flipping the first part sheet 110 along the centerline, stacking the two parts of the first part sheet 110 on top of each other, and then scaling each edge to form a sealed first inflatable floating chamber 101. Similarly, folding and flipping the second part sheet 130 along the centerline, stacking the two parts of the second part sheet 130 on top of each other, and then sealing each edge to form the sealed second inflatable floating chamber 102. Inflating air into the first inflatable floating chamber 101 and the second inflatable floating chamber 102 to provide buoyancy for the product, while the middle part sheet 120 supports the user's body. Using a single piece of original sheet and folding and scaling it reduces processing steps and improves the product's production efficiency. Additionally, with fewer parts needing sealing and connection, the product's seal integrity and strength are enhanced, reducing the risk of tearing and air leakage at the sealing and connecting positions, ensuring product stability, and lowering production costs. The sealing method typically involves high-frequency voltage or heat fusion welding processes. Such sealing methods can fuse sealed parts together, ensuring an airtight chamber and maintaining a stable structure of the product.

In this embodiment, the first part sheet 110 includes the first folding part 111 and the first connecting part 112. The first connecting part 112 is attached to the end of the middle part sheet 120, and the first folding part 111 is connected to the first connecting part 112. Sealingly connect the edge of the first folding part 111 to the edge of the first connecting part 112 to form the first inflatable floating chamber 101. With the above structure, a first mark line 113 is provided at a connection between the first folding part 111 and the first connecting part 112. By flipping along the first mark line 113, the folding of the first part sheet 110 can be quickly achieved, facilitating users to align the edge of the first folding part 111 with the edge of the first connecting part 112, and then quickly sealing and connecting the edge of the first folding part 111 and the edge of the first connecting part 112. This effectively enhances the production efficiency and the finished product rate. The shape of the first folding part 111 and the first connecting part 112 are substantially the same, rectangular, which effectively increases the utilization rate of the original sheet 100, prevents waste, and saves costs.

In this embodiment, the first folding part 111 is provided with the first free end 111*a* and two first side edges 111*b*, and the first connecting part 112 is provided with two second side edges 112*a*. Sealingly connect the first free end 111*a* to the end of the first connecting part 112 near the middle part sheet 120, and scalingly connect the first side edge 111*b* to the second side edge 112*a*. With the above structure, when in use, the first free end 111*a* is sealingly connected to the end of the first connecting part 112 near the middle part sheet 120, while the first side edge 111*b* is sealingly connected to the second side edge 112*a*, such that the sealed first inflatable floating chamber 101 is formed, which can stably provide buoyancy for the product, and ensuring a stable connection and making the product more robust and durable.

In this embodiment, the second part sheet 130 includes the second folding part 131 and the second connecting part 132. The second connecting part 132 is connected to the end of the middle part sheet 120, and the second folding part 131 is connected to the second connecting part 132. Sealingly connect the edge of the second folding part 131 to the edge of the second connecting part 132 to form the second inflatable floating chamber 102. With the above structure, the second mark line 133 is provided at a connection between the second folding part 131 and the second connecting part 132. By flipping along the second mark line 133, folding the second part sheet 130 can be quickly achieved, facilitating users to align the edge of the second folding part 131 with the edge of the second connecting part 132, and then quickly sealing the edge of the second folding part 131 and the edge of the second connecting part 132. This effectively enhances the production efficiency and the finished product rate. The shape of the second folding part 131 and the second connecting part 132 are substantially the same, rectangular, which effectively increases the utilization rate of the original sheet 100, prevents waste, and saves costs.

In this embodiment, the second folding part 131 is provided with the second free end 131*a* and two third side edges 131*b*, and the second connecting part 132 is provided with two fourth side edges 132*a*. Sealingly connect the second free end 131*a* to the end of the second connecting part 132 near the middle part sheet 120, and scalingly connect the third side edge 131*b* to the fourth side edge 132*a*. With the above structure, when in use, the second free end 131*a* is sealingly connected to the end of the second connecting part 132 near the middle part sheet 120, while the third side edge 131*b* is sealingly connected to the fourth side edge 132*a*, such that the scaled second inflatable floating chamber 102 is formed, which can stably provide buoyancy for the product, ensuring a stable connection and making the product more robust and durable.

In this embodiment, the first inflation valve 140 is also provided. The first folding part 111 or the first connecting part 112 is provided with the first air hole 103 that communicates with the first inflatable floating chamber 101. The first inflation valve 140 is sealingly connected to the first air hole 103, allowing gas to enter or be expelled. With the above structure, the first inflation valve 140 is scalingly connected to the first air hole 103. This allows the first inflation valve 140 to be fixedly connected to the first air hole 103 and ensures the product's air-tightness. When in use, inserting an inflation device into the first inflation valve 140 to inflate. The check valve inside the inflation valve effectively allows gas to enter the first inflatable floating chamber 101 in a one-way manner, ensuring the product's air-tightness and filling the first inflatable floating chamber 101 with enough gas to provide buoyancy to support the user's body. Additionally, when deflation is needed for the product, the check valve can be pressed to release the gas from the first inflatable floating chamber 101, reducing the product's volume for convenient portability.

In this embodiment, the second inflation valve 150 is also provided. The second folding part 131 or the second connecting part 132 is provided with the second air hole 104 that communicates with the second inflatable floating chamber 102. The second inflation valve 150 is scalingly connected to the second air hole 104, allowing gas to enter or be expelled. With the above structure, the second inflation valve 150 is sealingly connected to the second air hole 104. This allows the second inflation valve 150 to be fixedly connected to the second air hole 104 and ensures the product's air-tightness. when in use, inserting an inflation device into the second inflation valve 150 to inflate, the check valve inside the inflation valve effectively allows gas to enter the second inflatable floating chamber 102 in a one-way manner, ensuring the product's air-tightness, and filling the second inflatable floating chamber 102 with enough gas to provide buoyancy to support the user's body. Additionally, when deflation is needed for the product, the check valve can be pressed to release the gas from the second inflatable floating chamber 102, reducing the product's volume for convenient portability.

In this embodiment, the middle part of the middle part sheet 120 is provided with a plurality of through holes 121. With the above structure, the through holes 121 allow air and water to pass through, enhancing user comfort by preventing the middle part sheet 120 from extensively adhering to the user's skin and also enhancing the aesthetic appeal of the product.

In this embodiment, the through holes 121 are arranged in a rectangular array. This arrangement ensures a consistent distance between adjacent through holes 121, maintaining the product's strength and durability. The regular arrangement of the through holes 121 also contributes to the product's aesthetic appearance. Preferably, the through holes 121 can be arranged in other shapes, such as circular arrays, for added visual appeal and functionality.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A water float, comprising a first part sheet, a middle part sheet, and a second part sheet, wherein the first part sheet, the middle part sheet, and the second part sheet are three parts of a single original sheet, a portion of the first part sheet is folded and sealingly connected along edges to form a first inflatable floating chamber, and a portion of the second part sheet is folded and sealingly connected along edges to form a second inflatable floating chamber, the first inflatable floating chamber and the second inflatable floating chamber are configured to provide buoyancy in water, and the middle part sheet is configured to support user;

wherein the first part sheet, the middle part sheet, and the second part sheet are integrally formed;

wherein the first part sheet comprises a first folding part and a first connecting part, the first connecting part is connected to an end of the middle part sheet, the first folding part is connected to the first connecting part, and an edge of the first folding part is sealingly connected to an edge of the first connecting part to form the first inflatable floating chamber;

wherein the first folding part is provided with a first free end and two first side edges, the first connecting part is provided with two second side edges, the first free end is sealingly connected to an end of the first connecting part near the middle part sheet, and the first side edge is sealingly connected to the second side edge;

wherein the middle part sheet is provided with a plurality of through holes in middle.

2. The water float according to claim 1, wherein the second part sheet comprises a second folding part and a second connecting part, the second connecting part is connected to the end of the middle part sheet, the second folding part is connected to the second connecting part, and an edge of the second folding part is sealingly connected to an edge of the second connecting part to form the second inflatable floating chamber.

3. The water float according to claim 2, wherein the second folding part is provided with a second free end and two third side edges, the second connecting part is provided with two fourth side edges, the second free end is sealingly connected to an end of the second connecting part near the middle part sheet, and the third side edge is sealingly connected to the fourth side edge.

4. The water float according to claim 1, further comprising a first inflation valve, wherein the first folding part or the first connecting part is provided with a first air hole communicating with the first inflatable floating chamber, and the first inflation valve is sealingly connected to the first air hole and allows gas to enter or be expelled.

5. The water float according to claim 2, further comprising a second inflation valve, wherein the second folding part or the second connecting part is provided with a second air hole communicating with the second inflatable floating chamber, and the second inflation valve is sealingly connected to the second air hole and allows gas to enter or be expelled.

6. The water float according to claim 1, wherein the through holes are arranged in a rectangular array.

7. A method for manufacturing a water float, comprising:

providing a first part sheet, a middle part sheet, and a second part sheet, wherein the first part sheet, the middle part sheet, and the second part sheet are three parts of a single original sheet, folding a portion of the first part sheet and sealingly connect along edges to form a first inflatable floating chamber, and folding a portion of the second part sheet and sealingly connect along edges to form a second inflatable floating chamber, the first inflatable floating chamber and the second inflatable floating chamber are configured to provide buoyancy in water, and the middle part sheet is configured to support user.

8. The method for manufacturing a water float according to claim 7, wherein the first part sheet comprises the first folding part and the first connecting part, the first connecting part is connected to the end of the middle part sheet, the first folding part is connected to the first connecting part, and sealingly connect the edge of the first folding part to the edge of the first connecting part to form the first inflatable floating chamber.

9. The method for manufacturing a water float according to claim 8, wherein the first folding part is provided with a first free end and two first side edges, the first connecting part is provided with two second side edges, sealingly connect the first free end to an end of the first connecting part near the middle part sheet, and sealingly connect the first side edge to the second side edge.

10. The method for manufacturing a water float according to claim 7, wherein the second part sheet comprises a second folding part and a second connecting part, the second connecting part is connected to an end of the middle part sheet, the second folding part is connected to the second connecting part, and sealingly connect an edge of the second folding part to an edge of the second connecting part to form the second inflatable floating chamber.

11. The method for manufacturing a water float according to claim 10, wherein the second folding part is provided with a second free end and two third side edges, the second connecting part is provided with two fourth side edges, sealingly connect the second free end to an end of the second connecting part near the middle part sheet, and sealingly connect the third side edges to the fourth side edges.

12. The method for manufacturing a water float according to claim 8, wherein the water float further comprises a first inflation valve, the first folding part or the first connecting part is provided with a first air hole communicating with the first inflatable floating chamber, and sealingly connected the first inflation valve to the first air hole and allows gas to enter or be expelled.

13. The method for manufacturing a water float according to claim 10, further comprising a second inflation valve, the second folding part or the second connecting part is provided with a second air hole communicating with the second inflatable floating chamber, and sealingly connect the second inflation valve to the second air hole and allows gas to enter or be expelled.

14. The method for manufacturing a water float according to claim 7, wherein a plurality of through holes are provided in a middle part of the middle part sheet.

15. The method for manufacturing a water float according to claim 14, wherein the through holes are arranged in a rectangular array.

16. The water float according to claim 1, wherein the first part sheet, the middle part sheet, and the second part sheet are made of an identical material.

* * * * *